US007857248B2

(12) United States Patent
Eriksson et al.

(10) Patent No.: US 7,857,248 B2
(45) Date of Patent: Dec. 28, 2010

(54) CRUSHING APPARATUS AND METHOD OF PUTTING IT INTO OPERATION

(75) Inventors: Bengt-Arne Eriksson, Svedala (SE); Kristian Burhoff, Staffanstorp (SE)

(73) Assignee: Sandvik Intellectual Property AB, Sandviken (SE)

( * ) Notice: Subject to any disclaimer, the term of this patent is extended or adjusted under 35 U.S.C. 154(b) by 23 days.

(21) Appl. No.: 12/385,436

(22) Filed: Apr. 8, 2009

(65) Prior Publication Data

US 2009/0256013 A1 Oct. 15, 2009

(30) Foreign Application Priority Data

Apr. 11, 2008 (SE) ..... 0800823-7

(51) Int. Cl.
*B02C 2/00* (2006.01)

(52) U.S. Cl. ..... 241/207; 241/215

(58) Field of Classification Search ..... 241/207–216
See application file for complete search history.

(56) References Cited

U.S. PATENT DOCUMENTS 4,192,472 A 3/1980 Johnson

*Primary Examiner*—Faye Francis
(74) *Attorney, Agent, or Firm*—Drinker Biddle & Reath LLP

(57) ABSTRACT

A crushing apparatus has a gyratory crusher, which has an inner shell, an outer shell and an eccentric. A lubricating system is arranged to conduct a lubricant to at least one movable part, such as the eccentric of the gyratory crusher. The lubricating system has an oil sump, which collects the lubricant after it has been used for lubrication of the movable part, and a valve mechanism, which is arranged to apportion a lubricant flow in the crusher. The valve mechanism is arranged to assume a first position, in which a first sub-volume of the lubricant flow is conducted directly to the movable part for lubrication of the same and a second sub-volume is conducted directly to the oil sump, the second sub-volume constituting from about 30 to about 100% of the lubricant flow, and a second position, in which at least about 90% of the lubricant flow is conducted to the movable part for lubrication of the same.

5 Claims, 4 Drawing Sheets

CRUSHING APPARATUS AND METHOD OF PUTTING IT INTO OPERATION

CROSS-REFERENCE TO PRIOR APPLICATION

This application claims priority to Swedish Application No. 0800823-7 filed Apr. 11, 2008, which is incorporated by reference herein.

FIELD OF THE INVENTION

The present invention relates to a crushing apparatus, which includes a gyratory crusher having a crushing head, which supports a first crushing surface, a second crushing surface, which surrounds the first crushing surface, and an eccentric, which is arranged to cause the crushing head to execute a gyratory movement, the crushing apparatus further including a lubricating system, which is arranged to supply a lubricant for lubrication of at least one movable part, such as the eccentric, of the gyratory crusher.

The present invention also relates to a method of putting a crushing apparatus into operation.

BACKGROUND OF THE INVENTION

In crushing of hard materials, for example blocks of stone or ore, use is often made of a crusher of the gyratory crusher type. One example of a gyratory crusher is disclosed in U.S. Pat. No. 4,192,472. The gyratory crusher disclosed therein has an oil sump, which collects lubricating oil that has been pumped to the crusher's bearings for lubrication thereof. The lubricating oil is then pumped from the oil sump back to the bearings.

A problem associated with the crusher disclosed in U.S. Pat. No. 4,192,472 is that it is often difficult to start the crusher at low ambient temperatures, because under such conditions the lubricating oil is viscous and difficult to circulate in the crusher.

OBJECTS AND SUMMARY OF THE INVENTION

An object of the present invention is to provide a crushing apparatus where the above stated problems are avoided and where it is possible to start the crusher at low ambient temperatures without any operational disturbances.

This object is achieved by a crushing apparatus, which includes a gyratory crusher having a crushing head, which supports a first crushing surface, a second crushing surface, which surrounds the first crushing surface, and an eccentric, which is arranged to cause the crushing head to execute a gyratory movement, the crushing apparatus further including a lubricating system, which is arranged to supply a lubricant for lubrication of at least one movable part, such as the eccentric, of the gyratory crusher, which apparatus is characterized in that the lubricating system includes an oil sump, which is arranged to collect the lubricant after it has been used for lubrication of the at least one movable part, and a valve mechanism, which is arranged to apportion a lubricant flow in the crusher, the valve mechanism being arranged to assume a first position, in which a first sub-volume of the lubricant flow is conducted to the at least one movable part for lubrication of the same and a second sub-volume of the lubricant flow is conducted directly to the oil sump, the second sub-volume constituting from about 30 to about 100% of the lubricant flow and the first sub-volume amounting to the remaining part, if any, of the lubricant flow, and a second position, in which at least about 90% of the lubricant flow is conducted to the at least one movable part for lubrication of the same.

One advantage of this apparatus is that when it is put into operation under cold conditions the lubricant will be heated to the desired temperature more rapidly, since only a part of the lubricant flow passes the crusher's bearings, where the cooling effect is significant if the crusher is cold. This considerably reduces the risk, when the gyratory crusher is put into operation, of cold, and thus viscous, lubricant clogging pipes and equipment, such as filters, located downstream of the gyratory crusher, as seen in the direction of the lubricant flow.

According to a preferred embodiment, the valve mechanism includes a three-way valve, which is capable of assuming the first and the second position. An advantage of this embodiment is that a single valve is sufficient for the ability to assume the first and second positions.

According to a preferred embodiment, the oil sump includes at least two outlets, which extend in different directions out of the oil sump. This is advantageous in that return lines for the lubricant, which is to be conducted back from the oil sump to a lubricant reservoir, can be made short, since they can be connected to the outlet having the most appropriate orientation with respect to the spatial position of the lubricant reservoir. Short lubricant lines reduce the risk of the lines being clogged at low ambient temperature, when the lubricant is viscous.

According to one embodiment, the gyratory crusher includes a control system, which is arranged to sense the starting temperature of the gyratory crusher and to cause the valve mechanism to assume the first position when the gyratory crusher is put into operation at a starting temperature that is below a predetermined temperature. An advantage of this embodiment is that the control system, without manipulation by an operator, is capable of automatically setting the valve mechanism in the position that offers the best possible conditions for a successful starting procedure in view of the currently prevailing circumstances.

Preferably, the control system is arranged to cause the valve mechanism to shift from the first position to the second position after a predetermined time. This is advantageous in that once the lubricant has become warm and, thus, has heated the crusher, it is utilized as far as possible for its main purpose, which is to lubricate the movable parts of the gyratory crusher.

Another object of the present invention is to provide a method of putting a crushing apparatus into operation at low ambient temperatures, which method eliminates the problems of circulating viscous oil described above.

This object is achieved by a method of putting into operation a crushing apparatus, which includes a gyratory crusher having a crushing head, which supports a first crushing surface, a second crushing surface, which surrounds the first crushing surface, and an eccentric, which is arranged to cause the crushing head to execute a gyratory movement, the crushing apparatus further including a lubricating system, which is arranged to supply a lubricant for lubrication of at least one movable part, such as the eccentric, of the gyratory crusher, which method is characterized in that a starting temperature of the gyratory crusher is determined and compared with a predetermined value, a lubricant flow is supplied to a valve mechanism from a lubricant reservoir, and the supplied lubricant flow, if the starting temperature is below the predetermined value, is divided into a first sub-volume and a second sub-volume by the valve mechanism, the first sub-volume being conducted to the at least one movable part of the crusher for lubrication of the same and then conducted back to the lubricant reservoir, while the second sub-volume is bypassed around the at least one movable part of the crusher and conducted back to the lubricant reservoir, the second sub-volume constituting from about 30 to about 100% of the lubricant flow and the first sub-volume amounting to the remaining part, if any, of the lubricant flow.

An advantage of this method is that when starting under cold conditions the lubricant will not be heavily cooled in the bearings of the gyratory crusher. Since a gyratory crusher contains large amounts of steel, with high thermal conductivity, and large bearing surfaces, on which the lubricant is spread out in large, thin layers, the crusher will have a considerable cooling effect on the lubricant. By a part of the lubricant conducted to the valve mechanism not being used to lubricate the bearings of the gyratory crusher, but being instead bypassed around the bearings, the cooling effect will be limited, which alleviates the problems that may occur due to a cold, and thus viscous, lubricant.

According to a preferred embodiment, the second sub-volume, a predetermined time after the supply of lubricant to the valve mechanism has been initiated, is reduced so as to constitute no more than about 10% of the lubricant flow. When the lubricant that leaves the crusher a certain time after the supply of lubricant was initiated is approaching its working temperature, it is no longer necessary to bypass the lubricant around the crusher bearings. It is therefore advantageous to reduce the second sub-volume, so that the main part, or even better substantially the whole volume, of the lubricant flow is used for lubrication purposes.

According to one embodiment, the temperature of the lubricant flow which is made up of the sum of the first and second sub-volumes and which is conducted back to the lubricant reservoir is measured, the second sub-volume being reduced so as to constitute no more than about 10% of the lubricant flow when the lubricant flow which is conducted back to the lubricant reservoir has reached a predetermined temperature. By measuring the temperature of the lubricant flow that is returned from the crusher, i.e., the temperature of the lubricant flow resulting from the first and second sub-volumes having been brought together once more, an indication of whether the gyratory crusher has reached its operating temperature or not, and thus whether or not it is appropriate to reduce the second sub-flow, is obtained.

According to a preferred embodiment, the predetermined value for the starting temperature is maximum about 10° C. At temperatures below approximately about 10° C., and in particular below 0° C., the problems related to cold and viscous lubricant will be increasingly troublesome, and may cause operational disturbances. Suitably the ambient temperature is measured in the vicinity of the gyratory crusher, as a measure of the starting temperature of the gyratory crusher. It is often easier to measure the ambient temperature and use it as an indirect measure of the starting temperature, than it is to measure the actual starting temperature, i.e., the temperature in the bearings of the gyratory crusher as it is being put into operation.

In one aspect of the invention, there is provided a crushing apparatus, comprising a gyratory crusher having a crushing head, which supports a first crushing surface, a second crushing surface, which surrounds the first crushing surface, and an eccentric, which is arranged to cause the crushing head to execute a gyratory movement; a lubricating system, which is arranged to supply a lubricant for lubrication of at least one movable part of the gyratory crusher, wherein the lubricating system comprises an oil sump, which is arranged to collect the lubricant after it has been used for lubrication of the at least one movable part, and a valve mechanism, which is arranged to apportion a lubricant flow in the crusher, the valve mechanism being arranged to assume a first position, in which a first sub-volume of the lubricant flow is conducted to the at least one movable part for lubrication of the at least one movable part and a second sub-volume of the lubricant flow is conducted directly to the oil sump, the second sub-volume constituting from about 30 to about 100% of the lubricant flow and the first sub-volume amounting to the remaining part, if any, of the lubricant flow and a second position, in which at least about 90% of the lubricant flow is conducted to the at least one movable part for lubrication of the same.

In another aspect of the invention, there is provided a method of putting into operation a crushing apparatus, which comprises a gyratory crusher having a crushing head, which supports a first crushing surface, a second crushing surface, which surrounds the first crushing surface, and an eccentric, which is arranged to cause the crushing head to execute a gyratory movement, the crushing apparatus further comprising a lubricating system, which is arranged to supply a lubricant for lubrication of at least one movable part, such as the eccentric, of the gyratory crusher, wherein determining a starting temperature of the gyratory crusher and comparing the starting temperature with a predetermined value, supplying a lubricant flow to a valve mechanism from a lubricant reservoir, and dividing the supplied lubricant flow, if the starting temperature is below the predetermined value, into a first sub-volume and a second sub-volume by the valve mechanism, the first sub-volume being conducted to the at least one movable part of the crusher for lubrication of the same and then conducted back to the lubricant reservoir, while the second sub-volume is bypassed around the at least one movable part of the crusher and conducted back to the lubricant reservoir, the second sub-volume constituting from about 30 to about 100% of the lubricant flow and the first sub-volume amounting to the remaining part, if any, of the lubricant flow.

Further advantages and features of the invention will be apparent from the following description and the appended claims.

BRIEF DESCRIPTION OF THE DRAWINGS

The invention will be described below by means of embodiments and with reference to the appended drawings.

DETAILED DESCRIPTION OF THE PREFERRED EMBODIMENTS

Figure 1:
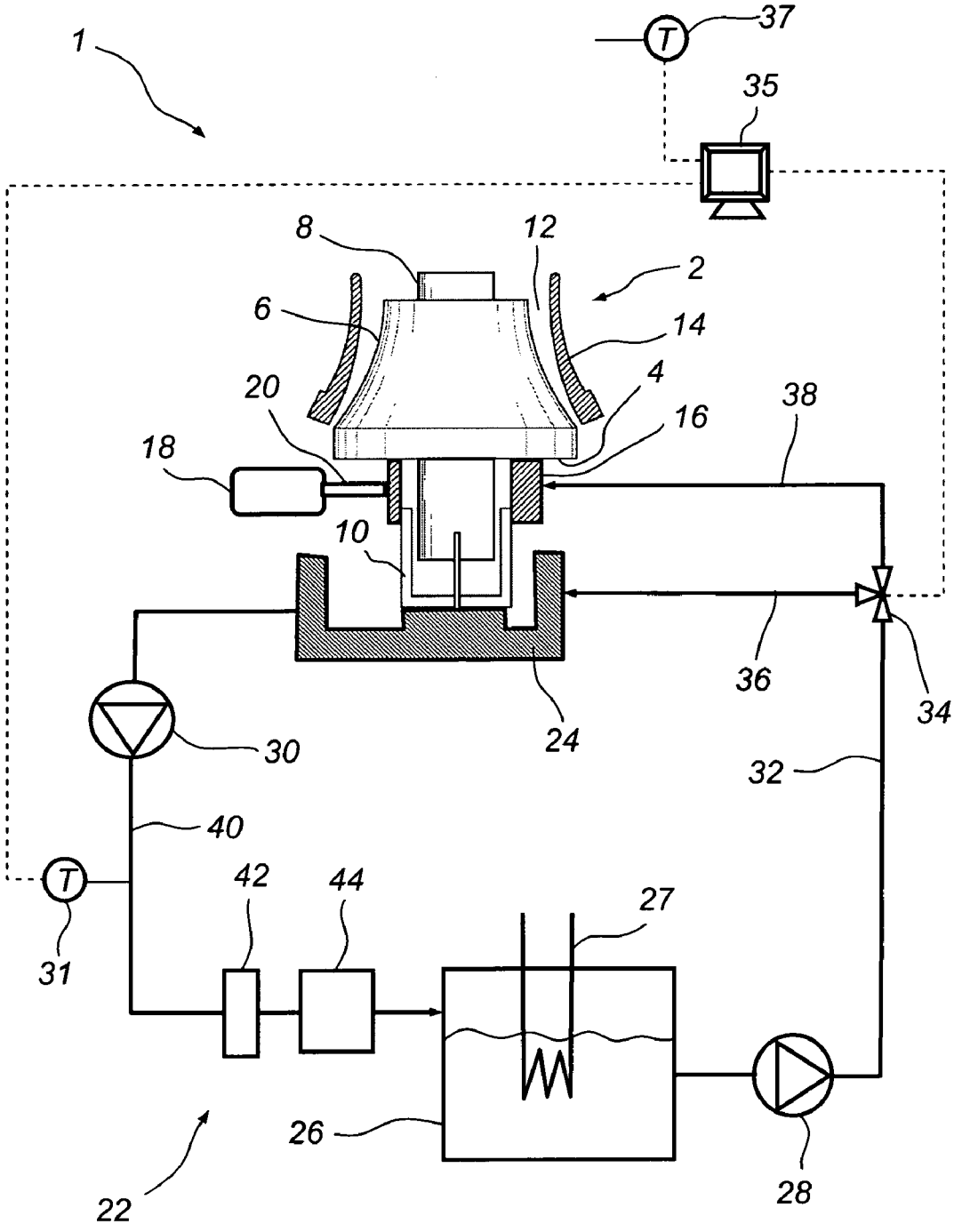
FIG. 1 is a schematic side view of a crushing apparatus including a gyratory crusher.

FIG. 1 illustrates schematically a crushing apparatus 1. The crushing apparatus 1 includes a gyratory crusher 2. The gyratory crusher 2 includes a crushing head 4, which supports a first crushing surface in the form of an inner shell 6, and which is mounted on a crusher shaft 8. The crushing head 4, which is mounted on the crusher shaft 8, can be moved in the vertical direction by means of a hydraulic cylinder 10, which is connected to the lower portion of the crusher shaft 8. The hydraulic cylinder 10 allows adjustment of a gap 12 formed between the inner shell 6 and a second crushing surface in the form of an outer shell 14, which surrounds the inner shell 6. The gyratory crusher 2 further includes an eccentric 16, which is arranged to cause the crushing head 4 to execute a gyratory movement, in a manner known, per se, in the art. A motor 18 has a drive shaft 20 by means of which the motor 18 can rotate the eccentric 16.

The crusher apparatus 1 has a lubricating system 22, which is arranged to lubricate the gyratory crusher 2 with the aid of a lubricant, such as lubricating oil. The lubricating system 22 includes an oil sump 24, which is arranged in the gyratory crusher 2 for collecting lubricating oil that has been pumped, inter alia, to the eccentric 16 for lubrication of the same. The lubricating system 22 further has an oil reservoir 26, which is arranged to contain lubricating oil, and a first pump 28, which is arranged to pump lubricating oil, inter alia, to the eccentric 16. A second pump 30 is arranged to pump lubricating oil back from the oil sump 24 to the oil reservoir 26. The oil reservoir 26 is provided with a heater 27, which may be, for example, an electric heater or a hot-water heater and which may be used to heat the lubricating oil in those instances when the ambient temperature is low. The lubricating system 22 further has a line 32 through which the first pump 28 is able to pump lubricating oil to a three-way valve 34. As will be described in more detail below, the three-way valve 34 is arranged to conduct lubricating oil to the oil sump 24 via a line 36 and/or to the bearings of the crusher 2, for example slide bearings arranged on the eccentric 16, via a line 38. The gyratory crusher 2 is controlled by a control system in the form of a control computer 35, which is also arranged to control the functioning of the three-way valve 34. The control computer 35 is arranged to receive information from a temperature gauge 37, which measures the ambient temperature in the vicinity of the gyratory crusher 2.

The second pump 30 sucks oil out of the oil sump 24 via a line 40 and pumps the oil via a filter 42, which filters out metal particles et cetera from the lubricating oil, and via a cooler 44, which is arranged to cool the lubricating oil when the crusher 2 has reached its operating temperature, back to the oil reservoir 26. A temperature gauge 31 is arranged to measure the temperature in the lubricating oil leaving the second pump 30.

According to an alternative embodiment, the lubricating oil may be conducted from the oil sump 24 to the oil reservoir 26 by gravitation, i.e., without the need for a second pump 30. In such a case it is important that the oil sump 24 is located higher up than the oil reservoir 26, and that the line 40 is short, so that a sufficiently steep incline is obtained to enable the lubricating oil, also when cold, to flow down into the oil reservoir 26. Moreover, it is suitable, in the absence of the second pump, for the filter 42 and the cooler 44 to be arranged on the line 32, so that the pump 28 can pump the lubricating oil through the filter 42 and the cooler 44.

Figure 2:
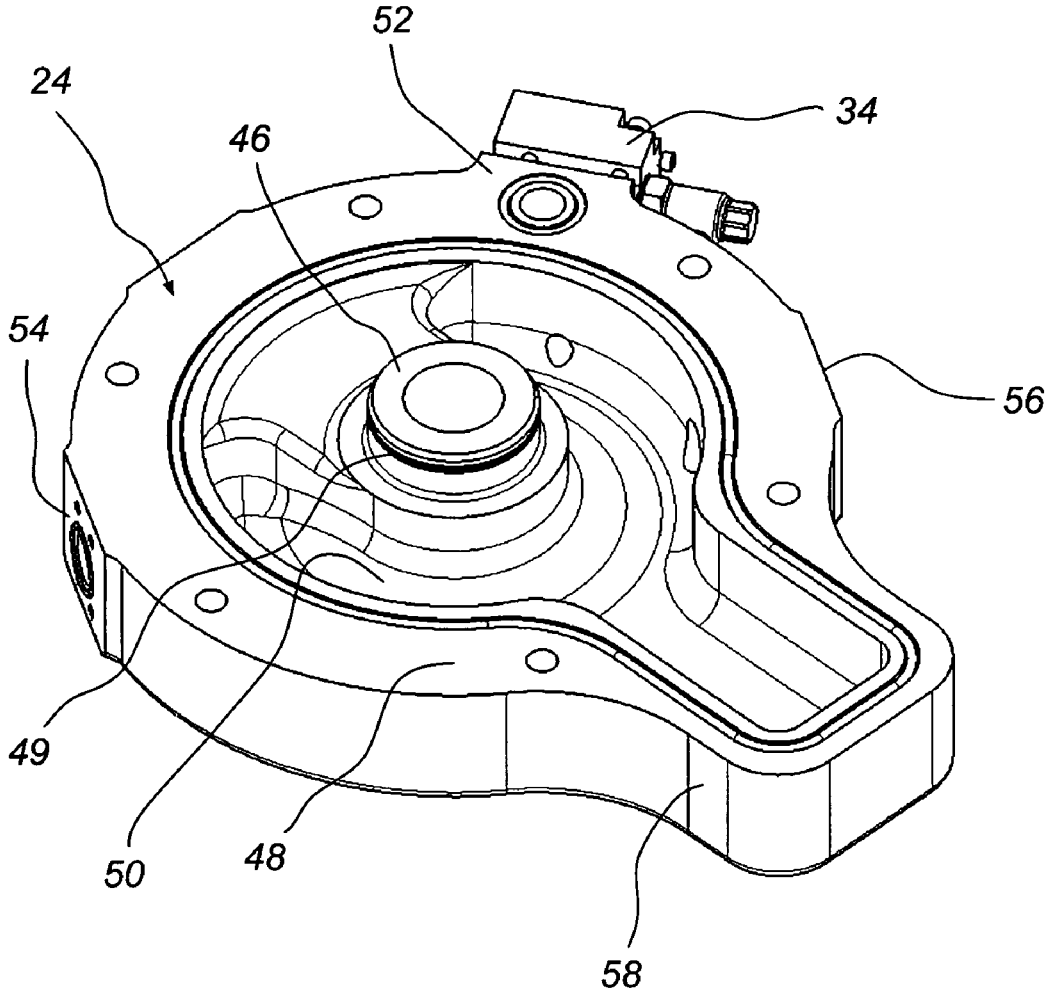
FIG. 2 is a three-dimensional view of an oil sump forming part of the crushing apparatus shown in FIG. 1.

FIG. 2 shows the oil sump 24 in more detail. The oil sump 24 has a central portion 46, which is arranged for connection to the crusher shaft 8 and the hydraulic cylinder 10. An outer wall 48 delimits the space 50 in which the lubricating oil is collected. The outer wall 48 seals against a frame, not shown in FIG. 2, which means that crushed material and dust are not able to penetrate into the space 50. The central portion 46 is provided with a sealing ring 49, which prevents hydraulic oil from the hydraulic cylinder 10 shown schematically in FIG. 1 from mixing with the lubricating oil in the space 50. Hence, the space 50 forms a closed space for lubricating oil only. In the outer wall 48, a connection 52 for supplying lubricating oil to the crusher and two outlets in the form of connections 54, 56 for removing lubricating oil from the oil sump 24 have been provided. The three-way valve 34 is coupled to the connection 52. In the embodiment shown in FIG. 2, the connection 56 is used to remove lubricating oil from the oil sump 24, whereas the connection 54 is blocked. The fact that the oil sump 24 has two connections 54, 56 for removing lubricating oil, which connections 54, 56 are arranged on opposite sides of the oil sump 24 and, thereby, are able to draw off lubricating oil in two different directions, offers the advantage that the connection closest to the oil reservoir 26 can be selected, which means that the oil can be conducted along the shortest possible path from the oil sump 24 to the oil reservoir 26.

The oil sump 24 further has a protruding portion 58. This protruding portion 58 is arranged to collect oil which has been supplied to the crusher's bearings, for example the bearings of the eccentric 16 shown in FIG. 1, and which then has been allowed to flow downwards to the drive shaft 20 shown in FIG. 1 for lubrication of the same. A substantial part of the lubricating oil that is conducted to the bearings of the gyratory crusher 2 through the line 38 shown in FIG. 1 will flow down into the protruding portion 58 of the oil sump 24.

Figure 3:
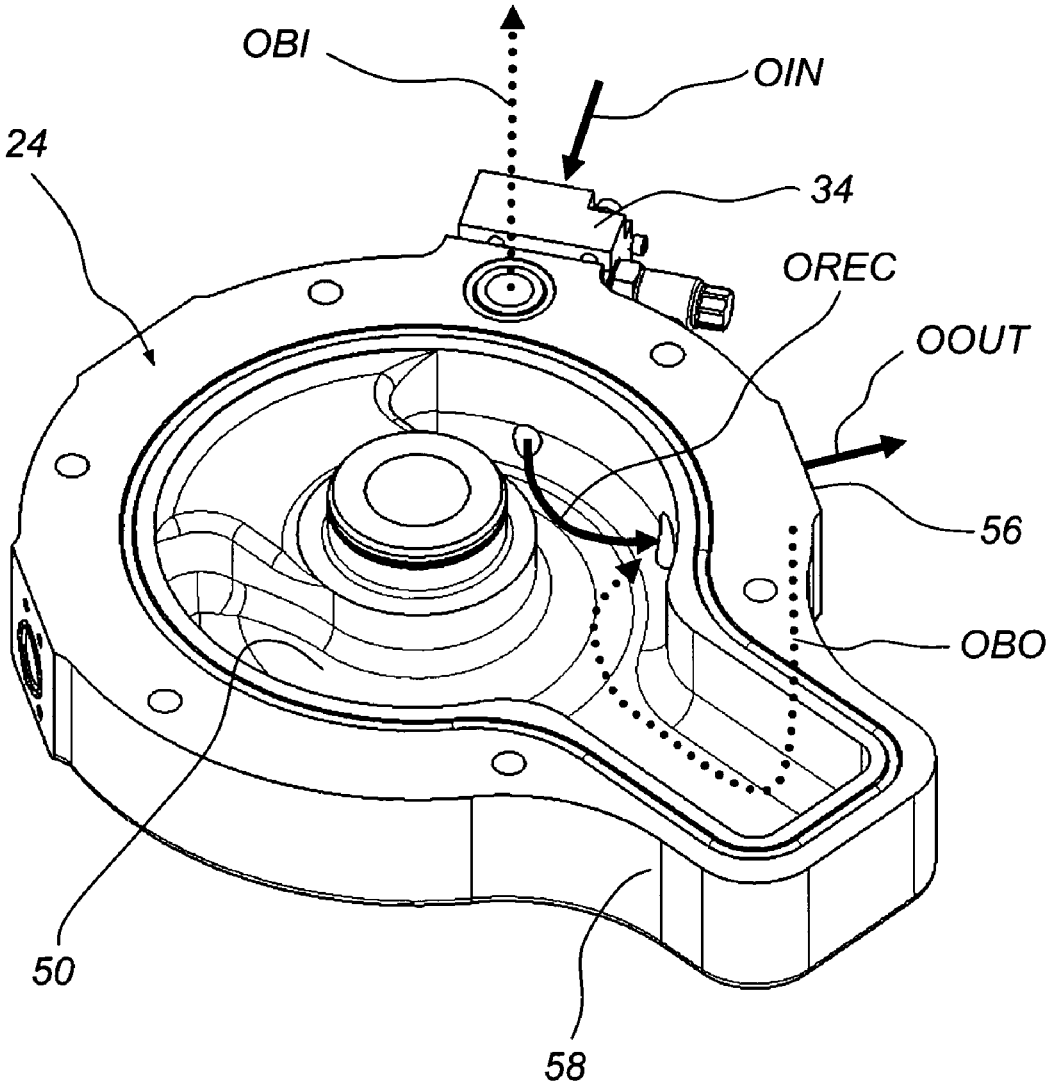
FIG. 3 is a three-dimensional view of the oil sump with a three-way valve located in a first position.

FIG. 3 illustrates how the lubricating system 22 shown in FIG. 1 functions during cold starting. By "cold starting" is here meant that the gyratory crusher 2 is to be started after having been switched off for a relatively long period of time, usually at least about 4 hours, under low ambient temperature conditions, usually an ambient temperature below 0° C.

The relevant temperature for determining whether a cold starting procedure is executed or not is the starting temperature of the gyratory crusher 2, i.e., the temperature in the bearings of the gyratory crusher 2 which are to be lubricated by the lubricating oil. The starting temperature can be measured directly, for instance by means of a temperature sensor mounted inside the crusher, for example adjacent the bearings of the eccentric 16. It is often easier, however, to measure the ambient temperature, for example, and use the ambient temperature as an indicator of the actual starting temperature. A measurement of the ambient temperature is suitably combined with information about how much time has passed since the operation of the gyratory crusher was last terminated. This is because the crusher will have a higher temperature than the surroundings for about an hour or a few hours after the operation was terminated.

Hence, when the control computer 35 shown in FIG. 1 has received instructions from an operator stating that the gyratory crusher 2 is to be started and, at the same time, has received information from the temperature gauge 37 indicating that the ambient temperature is below a first threshold value, for example below 0° C., and the control computer 35 is also in possession of information indicating that the gyratory crusher 2 has been off for more than a certain predetermined period of time, for example more than about 4 hours, the control computer 35 will instruct the three-way valve 34 to assume a first position and to start the heater 27, which heats the lubricating oil in the reservoir 26. When the oil in the reservoir 26 has been heated to the desired temperature the first pump 28 is started and begins to pump oil to the three-way valve 34. In this way, a flow of lubricant oil, referred to as OIN in FIG. 3, will be pumped to the three-way valve 34.

In its first position the three-way valve 34 is arranged to conduct, via the line 38 shown in FIG. 1, a first sub-volume OBI of the lubricant oil flow OIN to the bearings of the gyratory crusher 2. In FIG. 3, this first sub-volume OBI is illustrated by a dashed line. A second sub-volume OREC of the lubricating oil flow OIN is conducted via the line 36 shown in FIG. 1 directly to the space 50 in the oil sump 24. This second sub-volume, referred to as OREC in FIG. 3 and indicated by a continuous arrow, will leave the space 50 relatively quickly via the line 40 shown in FIG. 1. The second sub-volume OREC constitutes from about 30 to about 100% of the lubricating oil flow OIN, and even more preferred from about 50 to about 100% of the lubricating oil flow OIN. The first sub-volume OBI amounts to the remaining part, if any, of the lubricating oil flow OIN. Hence, the first sub-volume OBI may be at most about 70% of the lubricating oil flow OIN, in the case where the second sub-volume OREC constitute about 30% of the lubricating oil flow OIN, but the first sub-volume OBI may also be 0% of the lubricating oil flow OIN, i.e. non-existent, in the case where the second sub-volume OREC constitutes about 100% of the lubricating oil flow OIN.

Thus, the three-way valve 34 divides the incoming lubricating oil flow OIN into a first sub-volume OBI, which is conducted to the crusher's bearings, and a second sub-volume OREC, which is bypassed around the crusher's bearings and which is therefore not cooled in the bearings. The second sub-volume OREC should constitute about 30 to about 100% of the lubricating oil flow OIN that is pumped to the three-way valve 34.

The lubricating oil of the first sub-volume OBI that has passed the bearings of the crusher 2 flows down into the space 50 in the oil sump 24 in the form of a flow OBO, as illustrated by a dashed arrow in FIG. 3. The flow OBO is collected in the space 50 and leaves the sump 24 via the line 40 together with the second sub-volume OREC in the form of a common lubricating oil flow OOUT. The lubricating oil of the first sub-volume OBI passes the bearings of the gyratory crusher 2 and is heavily cooled due to its passage through the bearings of the cold crusher 2. Because a substantial part of the lubricating oil flow OIN will be conducted, in the form of the second sub-volume OREC, through the crusher 2 without being cooled in the crusher's bearings, i.e., without passing the bearings, the temperature of the oil flow OOUT will be relatively high, as compared with what would have been the case had the whole lubricating oil flow OIN been caused to pass through the crusher's bearings. As a result, the oil that reaches the second pump 30, as shown in FIG. 1, will be considerably more fluid and easy to handle and the risk of operational disturbances in the filter 42 and the cooler 44 caused by cold, highly viscous oil will be significantly reduced. In addition, it is ensured, owing to the second sub-volume OREC, that a flow of lubricating oil will always be conducted to the second pump 30 in conjunction with the starting procedure, which is something that cannot be guaranteed in prior art, since in prior art it may take quite some time for the oil that has been pumped to the crusher's bearings to reach the second pump under cold-starting conditions.

Figure 4:
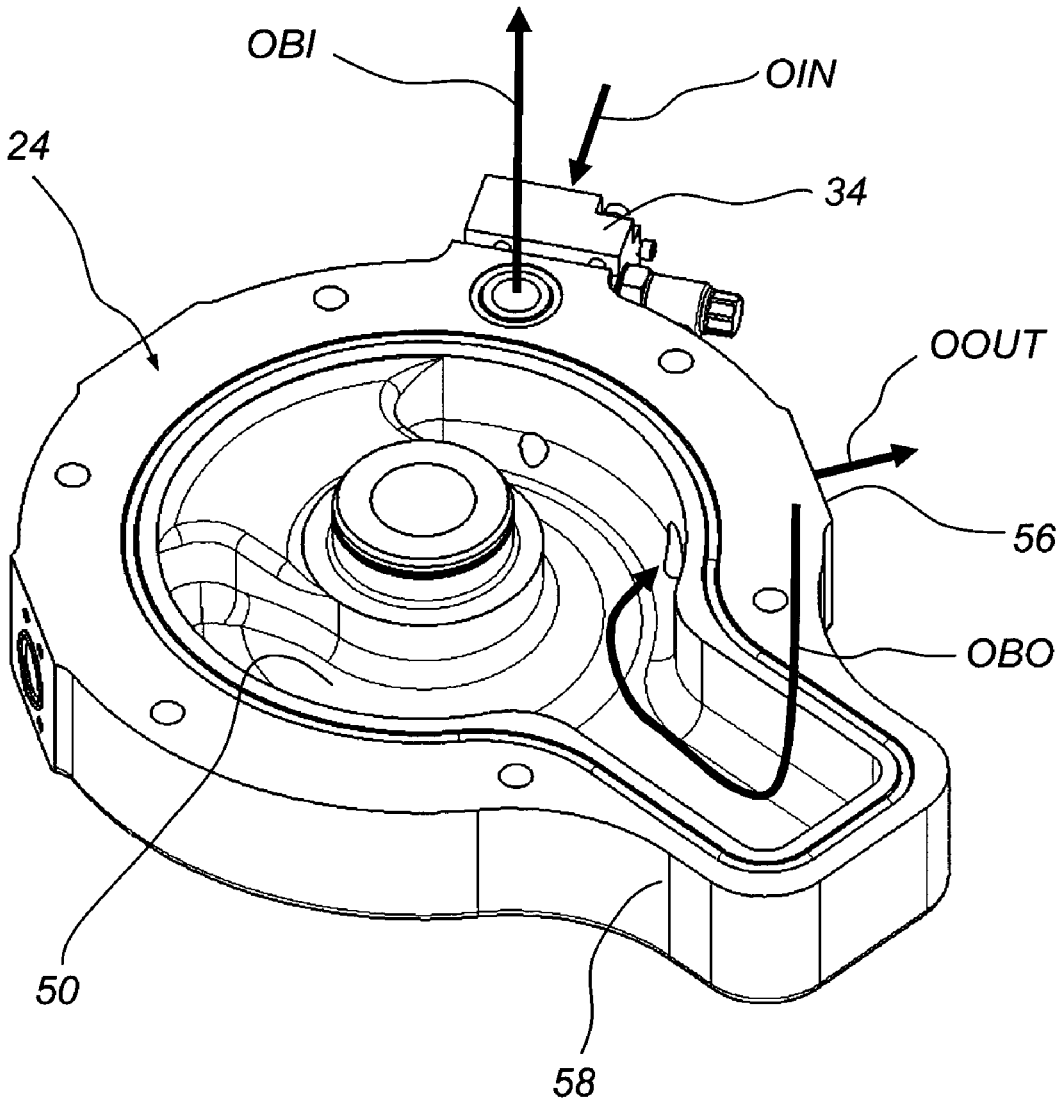
FIG. 4 is a three-dimensional view of the oil sump with a three-way valve located in a second position.

FIG. 4 illustrates how the lubricating system 22 shown in FIG. 1 functions once the lubricating oil has become warm. The control computer 35, as shown in FIG. 1, is capable of receiving a signal from the temperature gauge 31. When the lubricating oil has reached a certain temperature, for example about 30° C., the control computer 35 instructs the three-way valve 34 to assume a second position. As an alternative, the control computer 35 may instruct the three-way valve 34 to assume the second position when a certain predetermined time, for example, about two minutes, has passed after the gyratory crusher 2 was put into operation, or after the supply of lubricating oil to the three-way valve 34 was initiated.

In the second position of the three-way valve 34 at least about 90% of the lubricating oil flow, and even more preferred the whole lubricating oil flow, is conducted to the bearings of the gyratory crusher 2. Thus, the lubricating oil flow, referred to as OIN in FIG. 4, will be pumped to the three-way valve 34, as shown in FIG. 4, and this entire flow is conducted to the bearings through the line 38 shown in FIG. 1, in the form of the flow OBI, indicated by a continuous arrow in FIG. 4. After having passed the bearings of the crusher 2, the lubricating oil flows down into the oil sump 24 in the form of the flow OBO, as illustrated by a continuous arrow in FIG. 4, which flow OBO is collected in the space 50 and leaves the sump 24 via the line 40 shown in FIG. 1 in the form of an oil flow OOUT shown in FIG. 4.

Accordingly, in conjunction with cold starting of the gyratory crusher 2 the control computer 35 will control, during an initial phase, the three-way valve 34 to assume a first position, in which the second sub-volume OREC of the lubricating oil flow OIN is conducted directly to the oil sump 24 and further on to the second pump 30, as illustrated in FIG. 3, and will then, once the lubricating oil is warm, control the three-way valve 34 to assume a second position, in which the whole lubricating oil flow is conducted through the bearings of the crusher 2, as illustrated in FIG. 4.

Starting of the motor 18, and thereby initiation of rotation of the eccentric 16, may occur on different occasions. According to a first alternative embodiment, starting of the motor 18 is allowed only when the three-way valve 34 has assumed its second position, i.e., only when at least about 90% of the lubricating oil flow, and even more preferred the whole lubricating oil flow, is conducted to the bearings of the gyratory crusher 2, as has been described above with reference to FIG. 4. According to this first alternative embodiment, heating of the lubricating oil to the operating temperature thus occurs while the motor 18 and the eccentric 16 are idle. According to a second alternative embodiment, starting of the motor 18 is allowed already when the three-way valve 34 is in its first position, i.e., while the second sub-volume OREC of the lubricating oil flow OIN is conducted via the line 36 shown in FIG. 1 directly to the space 50 in the oil sump 24, as has been described above with reference to FIG. 3. In this second alternative embodiment, the first sub-volume OBI, which is conducted to the bearings of the crusher 2, is suitably greater than 0% of the lubricating oil flow with the three-way valve 34 in its first position and, more specifically, the first sub-volume OBI is suitably about from about 20 to about 60% of the lubricating oil flow OIN in order to provide lubrication of, inter alia, the bearings of the eccentric 16 also when the three-way valve 34 is in its first position.

It will be appreciated that a number of modifications of the embodiments described above are possible within the scope of the invention, as defined by the appended claims.

It has been described above how a three-way valve is used to apportion the lubricating oil flow between the lines 36 and 38. It will be appreciated that other valve mechanisms may be used for this purpose. For example, two two-way valves may be combined to provide the same function. However, a three-way valve offers a particularly compact and simple design. Another possibility is to use a single two-way valve. In this case, this single two-way valve is used to open and close the line 36 shown in FIG. 1. When this single two-way valve is open, i.e., is in its first position, the pressure drop and the pressure head in the line 38 will cause from about 30 to about 100% of the lubricating oil flow OIN to be conducted directly to the oil sump 24 in the form of the flow OREC. When such a single two-way valve is closed, i.e., shifts to its second position, the whole lubricating oil flow OIN will be conducted to the crusher's bearings, in the form of the flow OBI, via the line 38.

The apparatus described above may be used for different types of gyratory crushers, including gyratory crushers which have a rotary crusher shaft with a crushing head fixedly mounted thereon, and gyratory crushers which have a fixed crusher shaft and a crushing head adapted to rotate about the fixed crusher shaft.

It has been described above that the three-way valve can be instructed to shift from its first position to its second position after a certain period of time has passed since the starting procedure was initiated, or when the lubricant leaving the oil sump has reached a certain temperature. It will be appreciated that these two indicators may be used independently of one another, or in combination, and that other indicators adapted to indicate when the three-way valve is to shift from its first to its second position may be used.

The disclosures in the Swedish patent application No. 0800823-7, from which this application claims priority, are incorporated herein by reference.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. A crushing apparatus, comprising:

a gyratory crusher having a crushing head, which supports a first crushing surface, a second crushing surface, which surrounds the first crushing surface, and an eccentric, which is arranged to cause the crushing head to execute a gyratory movement;

a lubricating system, which is arranged to supply a lubricant for lubrication of at least one movable part of the gyratory crusher, wherein the lubricating system comprises an oil sump, which is arranged to collect the lubricant after it has been used for lubrication of the at least one movable part, and a valve mechanism, which is arranged to apportion a lubricant flow in the crusher, the valve mechanism being arranged to assume a first position, in which a first sub-volume of the lubricant flow is conducted to the at least one movable part for lubrication of the at least one movable part and a second sub-volume of the lubricant flow is conducted directly to the oil sump, the second sub-volume constituting from about 30 to about 100% of the lubricant flow and the first sub-volume amounting to the remaining part, if any, of the lubricant flow and a second position, in which at least about 90% of the lubricant flow is conducted to the at least one movable part for lubrication of the same.

2. The crushing apparatus as claimed in claim 1, wherein the valve mechanism comprises a three-way valve, which is capable of assuming the first and the second position.

3. The crushing apparatus as claimed in claim 1, wherein the oil sump comprises at least two outlets, which extend in different directions out of the oil sump.

4. The crushing apparatus as claimed in claim 1, which comprises a control system, which is arranged to sense the starting temperature of the gyratory crusher, and to cause the valve mechanism to assume the first position when the gyratory crusher is put into operation at a starting temperature that is below a predetermined temperature.

5. A crushing apparatus as claimed in claim 4, wherein the control system is arranged to cause the valve mechanism to shift from the first position to the second position after a predetermined time.

* * * * *